US006266847B1

(12) United States Patent
Krumhauer

(10) Patent No.: US 6,266,847 B1
(45) Date of Patent: Jul. 31, 2001

(54) DOOR OPERATOR AND PROCESS FOR OPERATION OF A DOOR OPERATOR

(75) Inventor: Peter Krumhauer, Berlin (DE)

(73) Assignee: GEZE GmbH, Leonberg (DE)

( * ) Notice: Subject to any disclaimer, the term of this patent is extended or adjusted under 35 U.S.C. 154(b) by 0 days.

(21) Appl. No.: 09/125,067

(22) PCT Filed: Feb. 7, 1996

(86) PCT No.: PCT/DE96/00185

§ 371 Date: Mar. 19, 1999

§ 102(e) Date: Mar. 19, 1999

(87) PCT Pub. No.: WO97/29265

PCT Pub. Date: Aug. 14, 1997

(51) Int. Cl.[7] ..... E05F 3/10

(52) U.S. Cl. ..... 16/79; 16/64; 16/79; 16/62; 91/224

(58) Field of Search ..... 16/49, 51, 56, 16/62, 64, 69, 79; 91/217, 216 B, 222, 224

(56) References Cited

U.S. PATENT DOCUMENTS 3,000,043 * 9/1961 Check ..... 16/64
4,115,897 * 9/1978 Zunkel ..... 16/79
4,263,694 * 4/1981 Jentsch ..... 16/62
4,967,444 * 11/1990 Korling et al. ..... 16/62
5,343,593 * 9/1994 Fayngersh ..... 16/62
5,502,874 * 4/1996 Lucas ..... 16/62

* cited by examiner

*Primary Examiner*—Anthony Knight
*Assistant Examiner*—Mark Williams
(74) *Attorney, Agent, or Firm*—Evenson, McKeown, Edwards & Lenahan, P.L.L.C.

(57) ABSTRACT

A door closer assembly and a method for operating a door closer assembly. The door closer assembly includes a housing and a door piston guided in the housing. The door piston is operably connected to move a door. A spring piston is guided in the housing and is operable to assist movement of the door piston toward a door closing position. The spring piston is situated in the housing and is acted upon by a spring. The door closer assembly also includes a hydraulic control circuit containing hydraulic fluid which is operable to selectively eliminate a coupling of the door piston and the spring piston from one another during a portion of the travel path of the door piston in the housing. The door closer of the present invention improves the comfort of passing through a door by providing different transmission ratios and therefore, different moment curves.

34 Claims, 7 Drawing Sheets

DOOR OPERATOR AND PROCESS FOR OPERATION OF A DOOR OPERATOR

BACKGROUND AND SUMMARY OF THE INVENTION

The invention relates to a programmable door closer which, depending on the travel and direction, considerably improves the comfort of passing though a door with different transmission ratios and therefore different moment curves. In addition, a method is described for operation of such a door closer.

A method and a system for controlling the force of a closing device can be found in DE 35 35 506 A1. The door is connected by means of a closing device in the form of a door closer and rod arms articulated with one another and mounted thereon being connected with the door frame. The control of the variable force for opening and then automatically closing the door is modified in a suitable fashion by shifting the end of the rod that is remote from the door-closing device, by the moment exerted by the closing device on the door in separate phases of opening and closing of the door. This system is a device that operates on external energy, i.e. an electric motor is provided that displaces a slider and simultaneously determines its position in a guide member. As a result, the motor is controlled in accordance with the desired opening angle.

U.S. Pat. No. 4,979,261 teaches a door closer with a variable articulation position. Because of a gear mounted on the closing shaft, said gear rolling along the door, the point of engagement of the rod and hence the entire moment aspect is automatically changed. The opening force is reduced in this mechanical way while the closing force increases at the same time.

In another U.S. Pat. No. 3,818,637 a device is described that allows rapid opening of a door.

A device that opens a door with a linear force is shown in U.S. Pat. No. 4,231,192. In this case an approximately linear curve of the force on the door as a function of the opening angle is achieved by an appropriate system of levers combined with external energy in the form of a power supply.

A door closer that operates with two pistons can be found in U.S. Pat. No. 4,040,144. This system likewise uses external energy in the form of air.

U.S. Pat. No. 4,419,786 describes a system by which the force required to open a door is reduced relative to normal door opening situations. A door closer is used in this case. By displacement of the remote end of the rod connected with the door closer, beginning at a certain opening angle, the ratio of forces is changed by utilizing additional spring forces and a hydraulic or pneumatic control. As a result, the moment exerted by the door closer on the door through the articulated rod system can be changed. This illustrated principle is very complicated and cannot be used universally with its ability to adapt to a very wide variety of different operating modes.

A device in the form of a door closer that is shown in Swedish disclosure document 469,342 consists of a housing in which two pistons are mounted movably. In addition, two springs are provided, each of which is directly associated with a piston and acts on it in the same direction. The other piston is connected with a piston rod whose rear end is received in a sealing fashion in a central bore of the second piston. The diameters of the two pistons are different. The fluid flow of the damping medium through the pistons is controlled by various channels in conjunction with valves.

This measure ensures that the force required for opening the door is low while a high force is available for the end phase of the closing process.

To reduce the opening moment, a solution is known from DE-OS 32 34 319 in which the required higher closing force is supplied by external energy for pretensioning a spring. In this solution, the additional pretensioning of the spring both by an electric motor and also by a piston can be carried out by pressure medium circulation generated by external energy.

The goal of the invention consists in improving a door closer in such fashion that a low opening moment is required when opening the door, while providing for a high closing moment when opening the door. For this purpose, no external energy is to be used like that used in several solutions in the prior art and at the same time a door closer of this kind is to be economical to manufacture and also simple to install.

The goal of the invention is achieved by virtue of the fact that the normally existing permanent connection between the opening and closing forces is eliminated. The permanent coupling is eliminated by virtue of the fact that in addition to the existing door piston, another spring piston is provided that is subjected to the action of the. closing spring. The additional pressure chambers that thus result by contrast to a normal door closer are connected with one another firstly by permanent channels but also by controlled channels or throttles and valves for the damping medium. By this provision and the addition of at least one hydraulic second transmission, the transmission of the force can be controlled. During the opening process and during the subsequent first part of the initial closing process, this additional hydraulic transmission has a force multiplication ratio of $\ddot{U}=1$. During the further closing process there is a range in which the force multiplication ratio $\ddot{U}<1$, i.e. the closing moment is reduced. It is only in a third part of the closing process, namely in the range in which the door is to slam shut, that the force multiplication ratio $\ddot{U}>1$ is reached. This means that the closing moment is greater than the opening moment.

In the embodiment of the idea according to the invention, both the spring piston and the door piston are given an L-shaped design. As a result, there are two displacement surfaces of different sizes. As a result of the geometric design of the displacement surfaces, adaptation and therefore almost a form of programming are possible because the damping medium can be controlled within the door closer housing accordingly as a result. The channels, pockets, throttles, and chambers located inside the door piston and spring piston can be viewed as switching means since they correspond to switching means likewise provided outside the piston. Such a possibility makes it possible for the individual piston chambers to be activated alternately, so that damping can be performed by throttles. An applied pressure can thus be obtained by appropriate check valves in certain circuits.

The hydraulic damping and switching means permit a deliberate and known damped movement of the door piston and the spring piston. For this purpose, according to a method to be specified, a control is performed. A method of this kind for example can proceed such that when the door is opened, which can take place manually or with a power-actuated drive, and during the subsequent closing process which is possible singly and solely by the energy stored in the spring reservoir, up to a door opening angle that is to be determined and hence can be selected individually, the spring piston and the door piston move at the same speed as a result of a pressure equalization between all of the piston chambers filled with the hydraulic fluid. It is only above a certain opening angle of the door that a control can be activated that causes a separation of the door piston from the spring piston. As a result, the door piston moves away from the spring piston, which represents a smaller multiplication ratio. In the final range of the closing process, i.e. in the range in which the door is also intended to engage securely into the latch by means of the striker plate, the two pistons approach one another once again with increased closing force.

With such a method it is possible for the door closer to have, as a function of travel and direction, at least two different multiplication ratios and hence different moment curves. As a result of the idea according to the invention, additional hydraulic transmissions can be interposed in unlimited numbers that would result in an infinite number of different multiplication ratios. Therefore an extremely accurate tuning of the moment curves could be achieved with the invention.

The invention will now be described in greater detail with reference to one possible embodiment shown schematically.

Other objects, advantages and novel features of the present invention will become apparent from the following detailed description of the invention when considered in conjunction with the accompanying drawings.

BRIEF DESCRIPTION OF THE DRAWINGS

FIG. 10 is the same as FIG. 7 depicting the door closer in, range a.

DETAILED DESCRIPTION OF THE DRAWINGS

Figure 4:
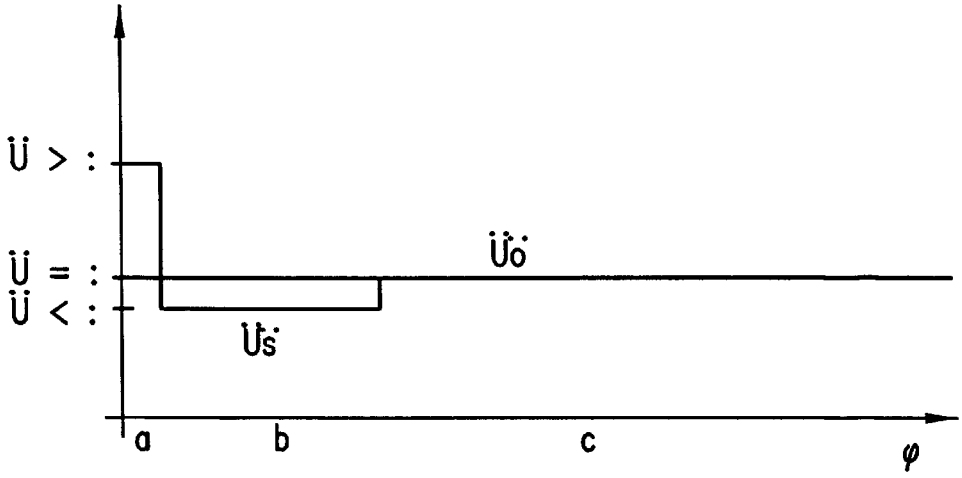
FIG. 4 is a graph of the multiplication ratio curves of the connected transmission.

FIG. 4 shows one possible transmission ratio curve that can result from an additional transmission being connected with the transmission ratios for the opening and closing process of a door for a wide variety of different ranges of the closing process. The following definitions are used:

a Actual closing range with a high moment requirement (approximately 5° door opening angle) and hence with a high closing force;

b Range with low closing force;

c Opening range (approximately 130° opening angle).

Figure 3:
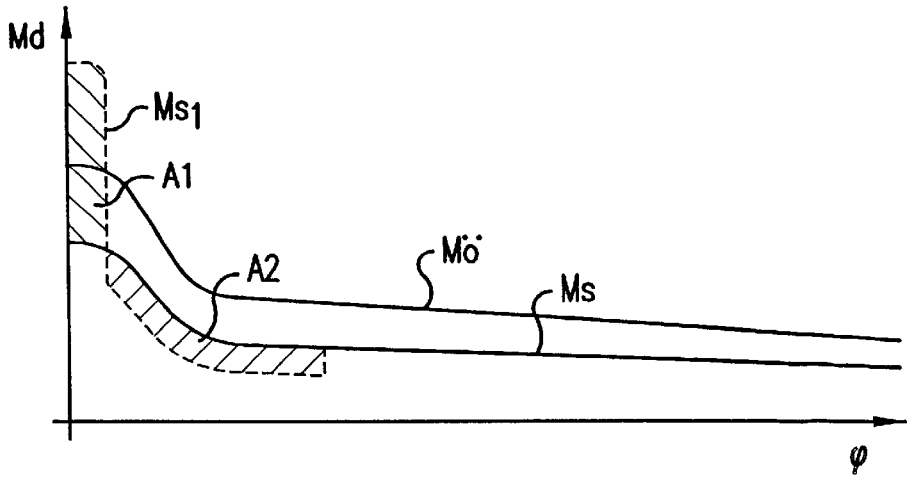
FIG. 3 is a graph showing opening and closing moment curves versus door opening angle.

By superimposition on the characteristic of the existing multiplication ratio (door closers with one piston), the force multiplication ratio produces the moment curve represented in FIG. 3 by the dashed lines for closing process S1. The moment curve for the opening process is retained. The displacement of the original moment curve MS to MS1 then corresponds to the energy equation when the energy areas A1 and A2 thus formed are equal to one another. As a result of this solution statement, i.e. the control of the moment curve, the goal is achieved, namely the closing moment MS1 in the closing range is much higher than the opening moment MO. This solution for a transmission located downstream is demonstrated using one possible hydraulic solution described below. Other also purely mechanical solutions are also possible.

Figure 1:
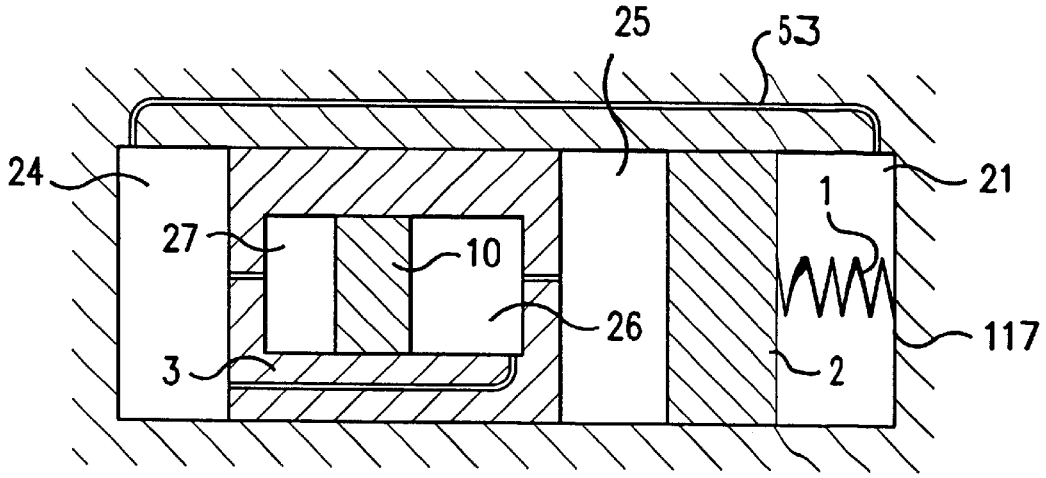
FIG. 1 is a diagram showing the elimination of the coupling between the spring piston and the door piston and the increased force multiplication which it makes possible in a door closer constructed according to preferred embodiments of the present invention.

In FIG. 1, the schematic separation of spring piston 2 from door piston 3 is shown. As a result of this separation, an additional chamber 25 is created that is located between spring piston 2 and door piston 3, and is likewise filled with hydraulic fluid. Thus, three pressure medium chambers are provided, namely a spring chamber 21, a door piston chamber 24, and chamber 25. Door piston chamber 24 is constantly connected through a channel 53 with spring chamber 21. In another arrangement, namely with the insertion of another piston located inside door piston 3, which can be formed for example by a pinion cage, internal piston 10 is produced which as a result creates two additional pressure medium chambers, namely an internal piston chamber 26 and an internal piston chamber 27. Internal piston chamber 26 is connected with chamber 25 by a channel. Likewise internal piston chamber 27 is connected by pressure medium through a channel with door piston chamber 24.

Figure 2:
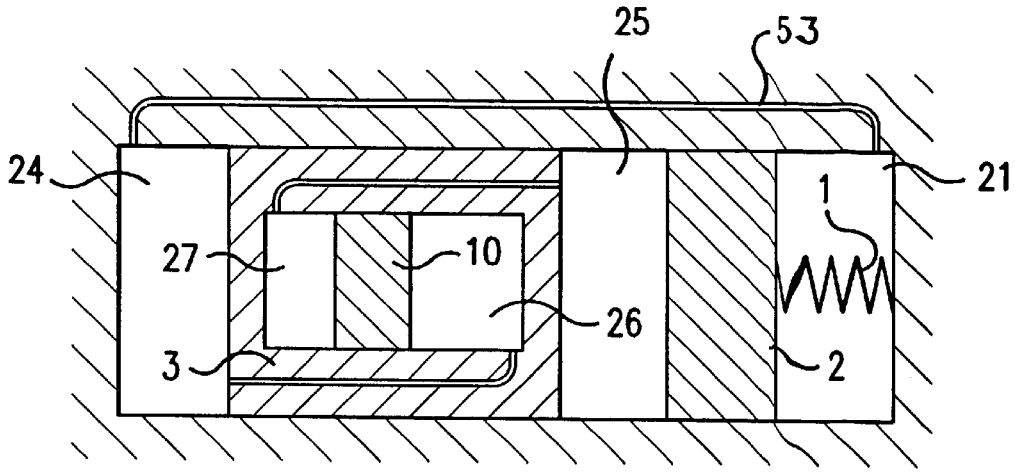
FIG. 2 is diagram similar to FIG. 1 but showing other preferred embodiments of the invention, with a reduction of the force.

In the embodiment of the idea according to the invention, as shown in FIG. 2, internal piston chamber 26 can also be connected with door piston chamber 24 and internal piston chamber 27 can be connected with chamber 25.

Figure 5:
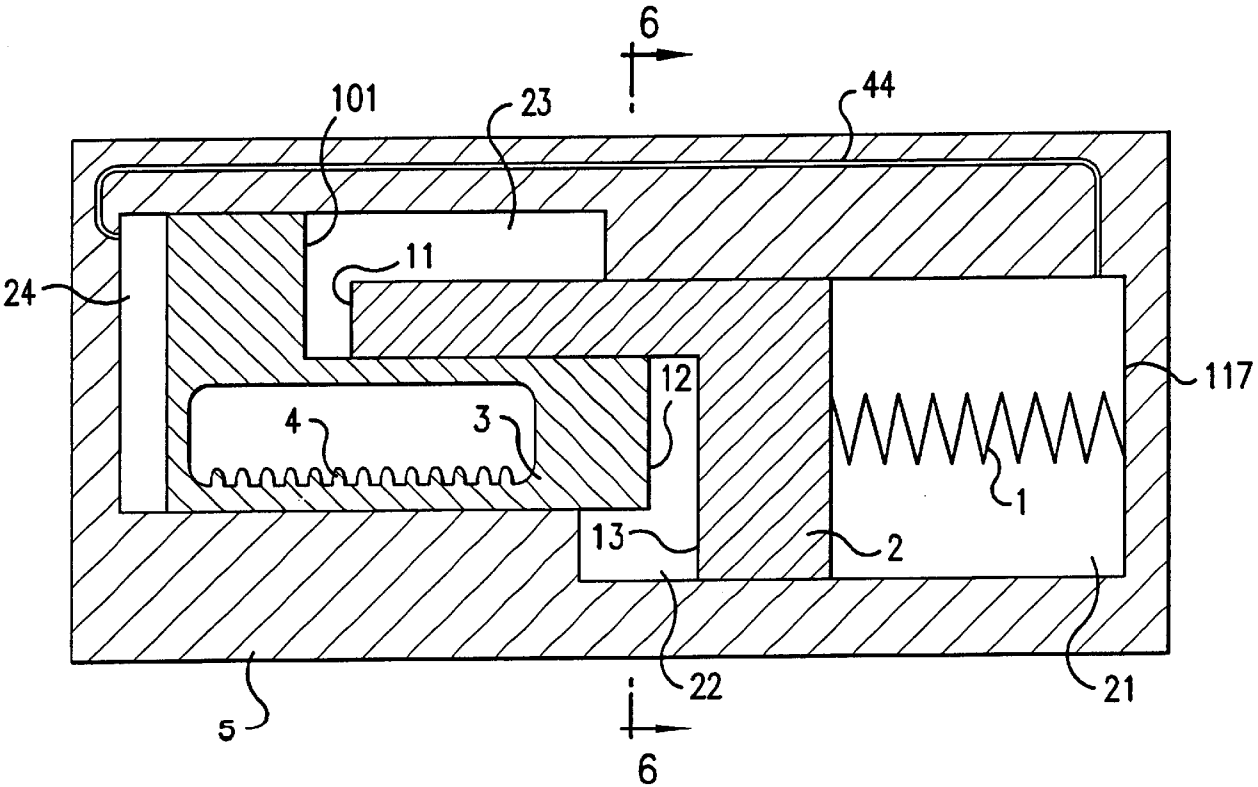
FIG. 5 is a cross section through a door closer with an L-shaped piston without hydraulic switching means.

FIG. 5 shows a basic design of the solution statement described above. Door piston 3 and spring piston 2 are located within a housing 5. Spring piston 2 is urged by spring 1 which functions as a power-storage device. On the other side, spring 1 abuts side wall 117 of housing 5. In door piston 3 there are teeth 4, which are operatively connected with a pinion cage that is connected with a drive axis that projects outside housing 5.

At this drive axis, the rod, not shown, is fitted on one side, with the other free end of the rod for actuating the door being articulated either to the door or to the door jamb. In contrast to the prior art, there is no permanent coupling between spring 1 and door piston 3. Instead, in this case, by the interposition of a hydraulic transmission, namely by spring piston 2, door piston 3, housing 5, and the hydraulic chambers filled by the latter with the damping medium, namely spring chamber 21, piston chamber 22, piston chamber 23, and door piston chamber 24, are formed.

Figure 6:
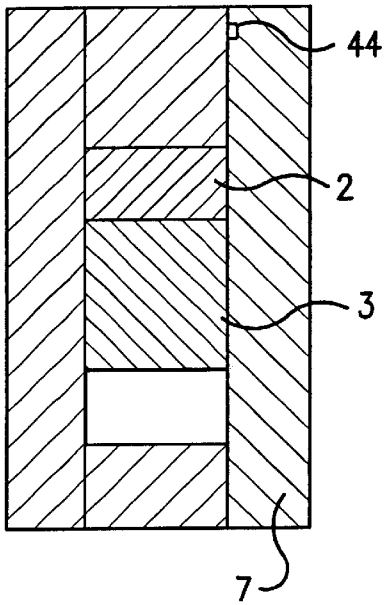
FIG. 6 is a section through the door closer in FIG. 5.

By the choice of L-shaped pistons, namely door piston 3 and spring piston 2, two displacement surfaces of different sizes are formed by each of the end faces of the pistons. In door piston 3 these are surface 101 and surface 12. In spring piston 2 they are surface 11 and surface 13. However, in order to allow movement of the piston, door piston chamber 24 is constantly connected with spring chamber 21 by a channel 44. It is clear from FIG. 6 that this channel 44 is located in a side plate 7. In addition to the L-shape of the door piston and the spring piston, any other shape that could be manufactured by technology can also be chosen.

Figure 7:
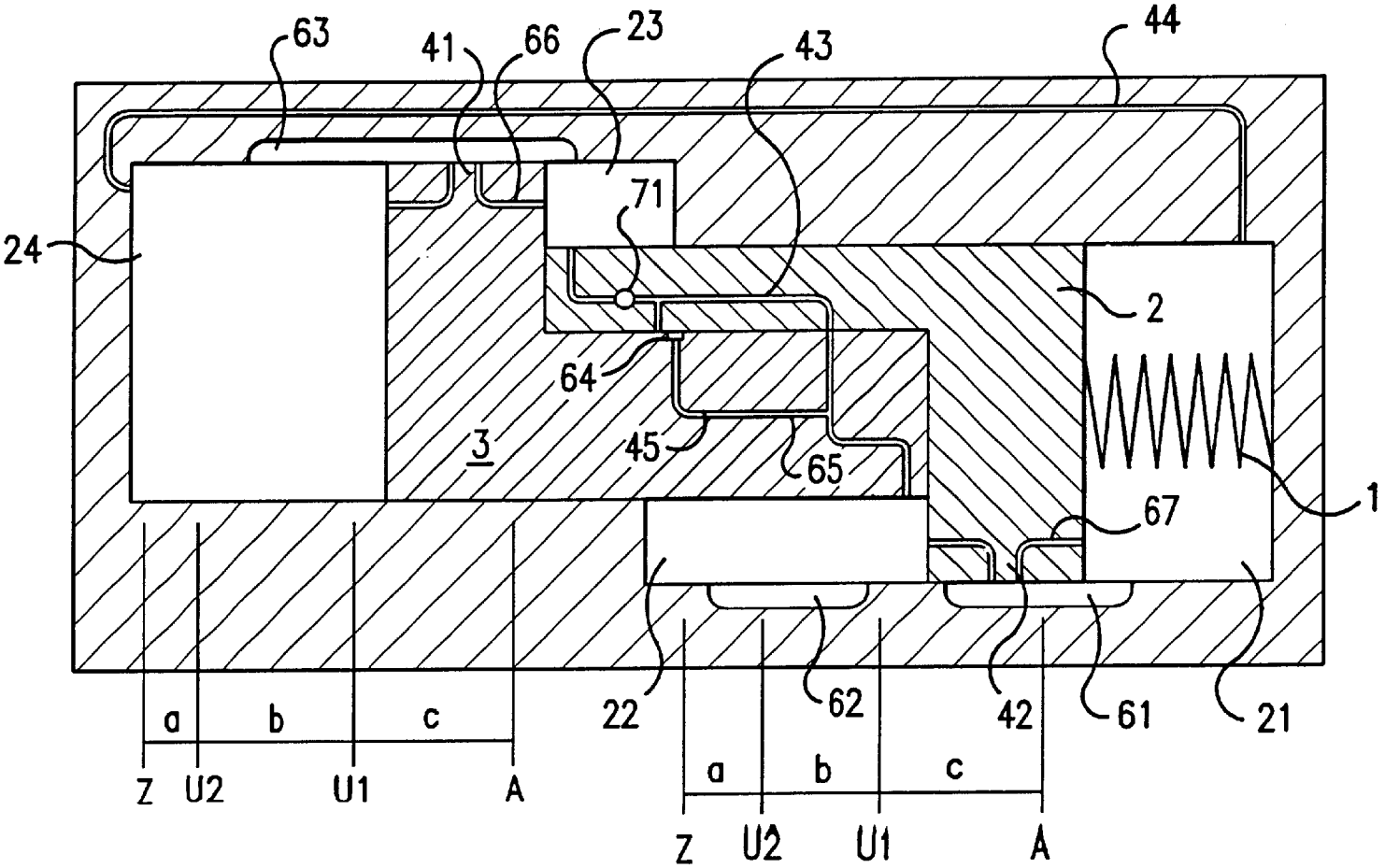
FIG. 7 is a cross section through the door closer with an L-shaped piston with hydraulic switching and damping means in various switching positions.

A door closer whose movement pattern is located within the closing process is shown in FIG. 7. In FIG. 7 ranges a, b, and c are also shown as discussed earlier in FIG. 4. The ranges here however are not shown to scale for improved understanding. In addition to the ranges, marked with capital letters, the individual states are also indicated. They have the following meanings:

A Door is in the "open" state

U1 Transition from range c to b

U2 Transition from range b to a

Z Door is in the "closed" state

The arrows at the lower ends of the pistons show the applicable range or state as described above.

A channel 42 located in spring piston 2 connects piston chamber 22 with spring chamber 21 through a pocket 61 in door closer housing 5. Similarly, a channel 41 bridges piston chamber 23 with door piston chamber 24 by means of a pocket 63. Basically, it must be stated that the length of a pocket is to accommodate when a pressure medium chamber is connected with another or is closed. As a result of the connection described previously, it is clear that door piston 3 and spring piston 2 are hydraulically inoperative so that a direct coupling between spring 1 and door piston 3 is produced as a result of contact of surface 11 with surface 101 and surface 12 with surface 13. The result of this is that the multiplication ratio Ü=1. The pressure that develops inside the housing, namely in door piston chamber 24, is equalized by the vacuum in spring chamber 21 because a channel 44 is always open between the two chambers. As the diagram shows, the door, not shown, is still in range c of the closing angle.

Figure 8:
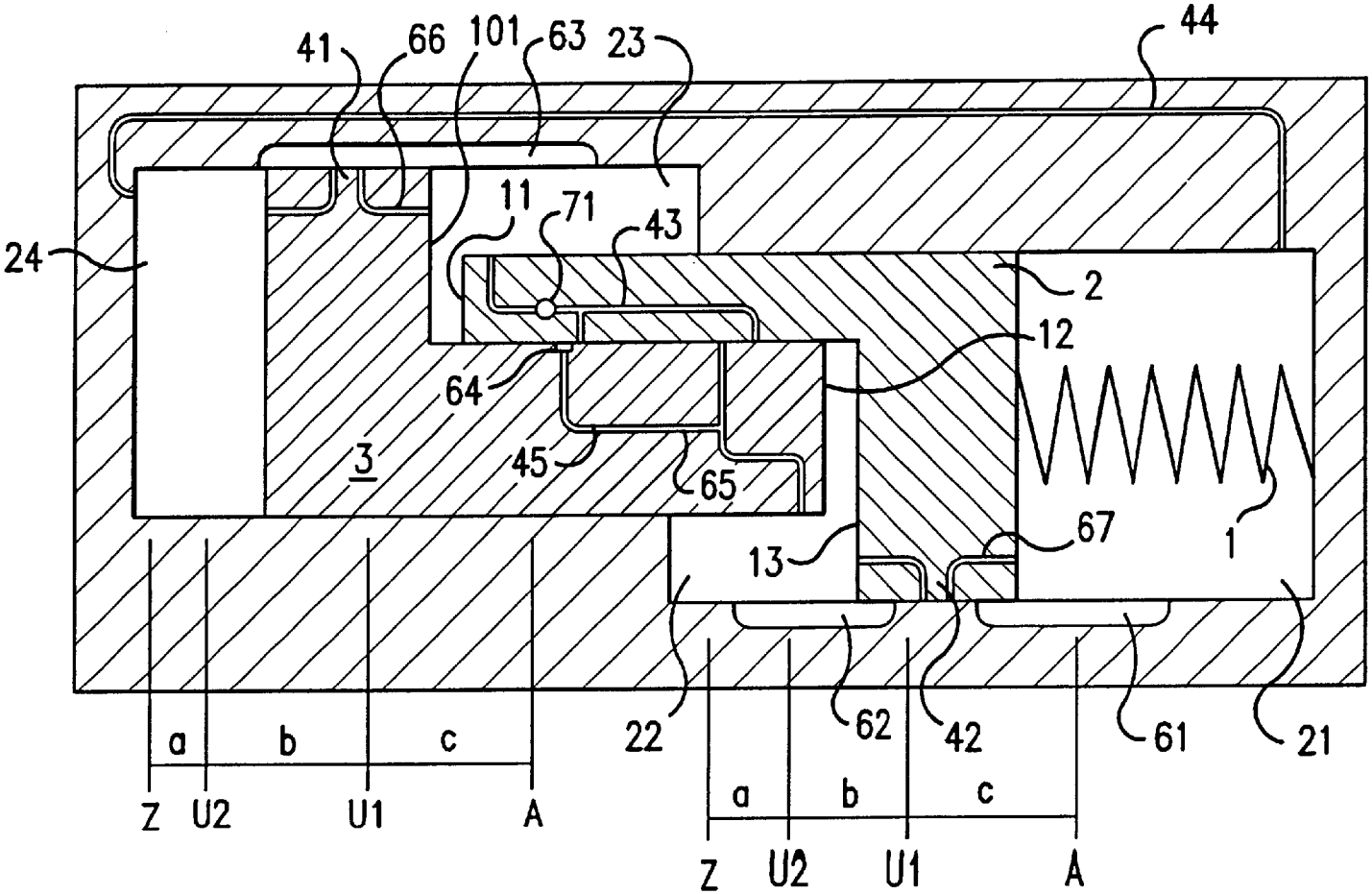
FIG. 8 is the same as FIG. 7, depicting the door closer in range c.
Figure 9:
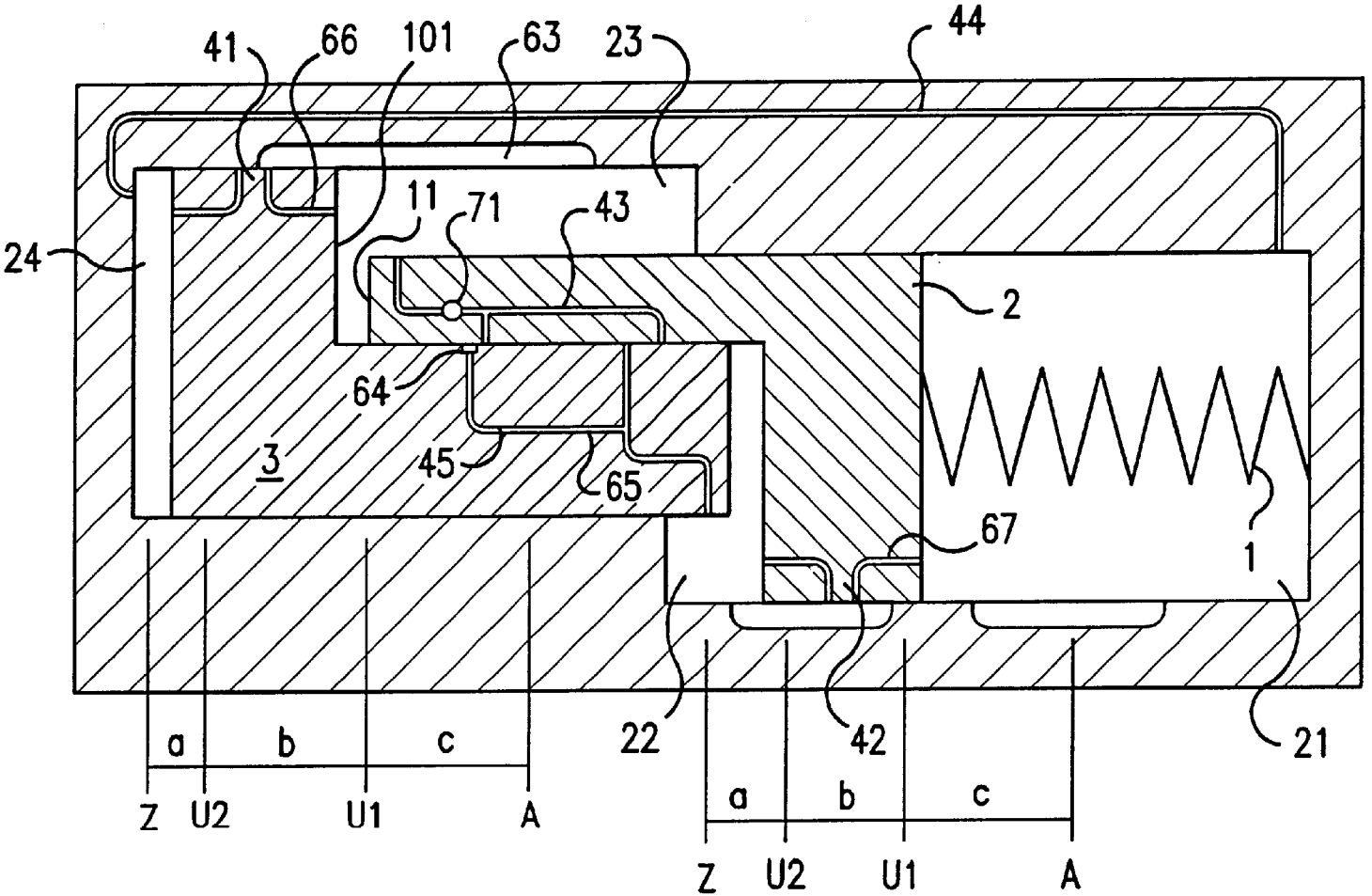
FIG. 9 is the same as FIG. 7, depicting the door closer in range b.

As the door continues to close,range b is reached, which is shown in FIG. 8. The previously open channel 42 is then closed, since there is no pocket provided in this partial area. As a result, the lower part of spring piston 2 becomes operative. By contrast, channel 41, which is located in the vicinity of-pocket 63 and thus connects the upper part of spring piston 2 and simultaneously also the upper part of door piston 3, is hydraulically inoperative. However, because of its larger displacement surface 13, the spring piston compresses a larger quantity of hydraulic medium at the same speed than the smaller displacement surface 12 of door piston 3 can accept. As a result, door piston 3 moves away at a higher speed from spring piston 2 than the spring piston can move under the force of spring 1. Accordingly, the multiplication ratio between spring piston 2 and door piston 3 is less than 1.

At the beginning of range b, spring piston 2 and door piston 3 are still in contact. Compensation of the pressure in piston chamber 2 in this state is prevented by a channel 43 with a check valve 71 located therein. At the same time, the movement of the two pistons is damped by a throttle 66 in door piston 3. This range b results from the selected multiplication ratio.

As the closing process proceeds, both pistons reach range a as a result of the closing process taking place. This range, which is intended to perform the actual closing of the door, must be provided with a much higher force. Here again, for improved understanding, this range is shown much larger. In contrast to the range described earlier, channel 42 is now opened by a pocket 62 that becomes operative. At the same time however channel 41 is blocked by the lack of a pocket. By this measure, only the upper part of spring piston 2 and/or door piston 3 is operative. As a result of the fact that area 11 of spring piston 2 is smaller than displacement area 101 of door piston 3, a multiplication now necessarily takes place to "slower" but as seen from the force side, it means a multiplication ratio Ü>1. As a result, spring piston 2 and door piston 3 are moved once again into positions such that they approach one another again in this range. The movement of the two pistons is damped by a throttle 67 in spring piston 2.

Figure 10:
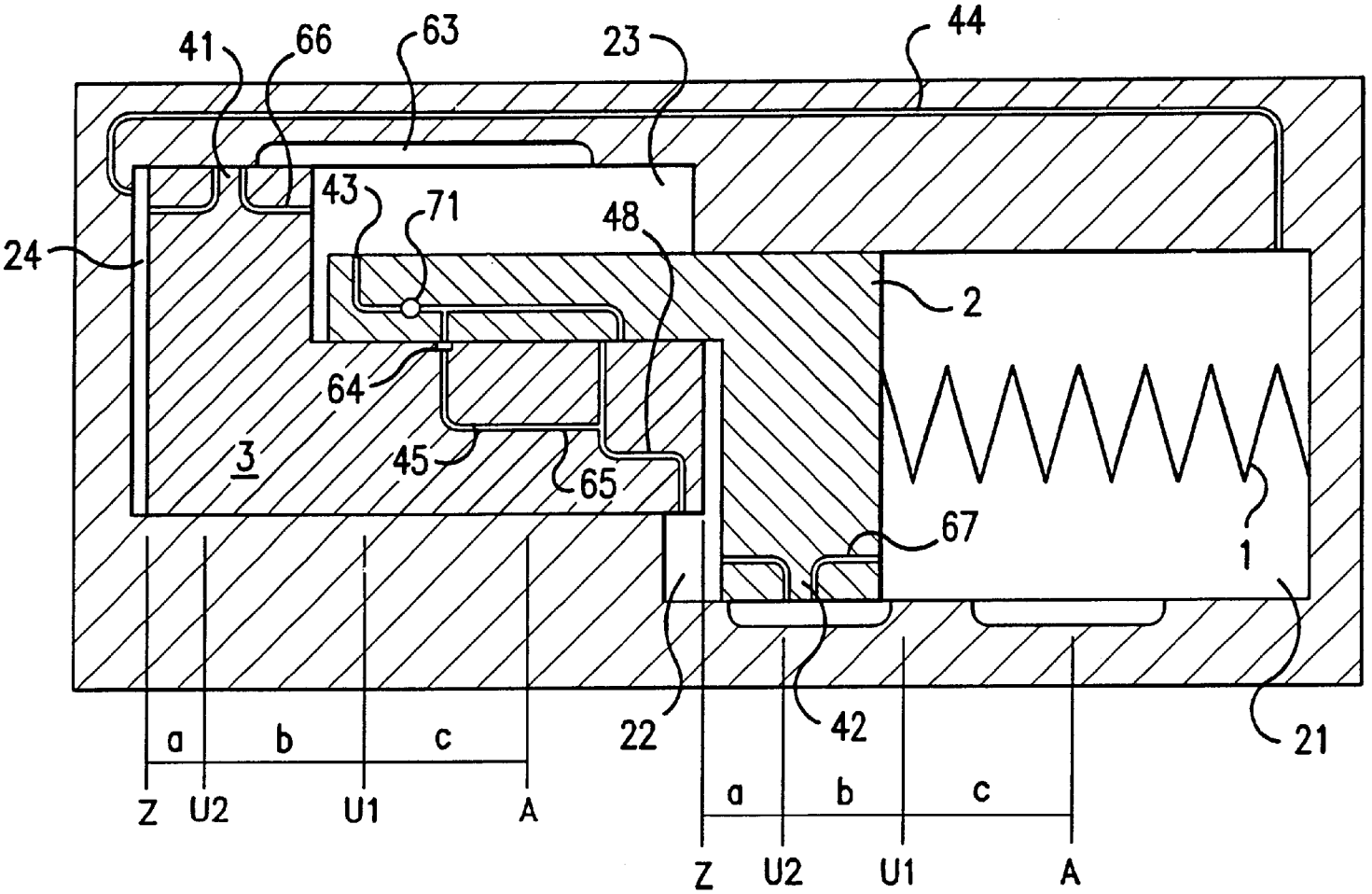

The final part of the closing process is shown in FIG. 10. Here the door is closed and the door piston is in its closed position Z which is located in front of the stop in the housing. The contact between spring piston 2 and door piston 3 however has not yet been created. A pocket 64, channel 45, and a channel 48 are connected together by channel 43 and the check valve 71 of spring piston 3 located therein such that a connection is created between piston chambers 22 and 23. As a result it is possible for the contact between spring piston 2 and door piston 3 to be created once more. As a result of the sharp throttling produced by a throttle 65, located preferably in door piston 3, however, the high pressure in piston chamber 23 is simultaneously prevented from falling. As soon as contact has been made, the pressure is released through channel 43 and the multiplication ratio Ü=1 is restored.

As a result of the corresponding distance between the end position and the stop of door piston 3, the distance between spring piston 2 and door piston 3 is also compensated at the same time since at the beginning of the closing process, corresponding tolerances between the door movement and the processes in the door closer can be compensated in this way.

During the opening process of the door, a constant contact between spring piston 2 and door piston 3 exists as is also shown in FIG. 7. A multiplication ratio Ü=1 applies to this. The resultant pressure in piston chamber 23 and the necessarily resulting vacuum in piston chamber 22 are compensated by channel 43 and check valve 71 connected in between.

The great advantage of the idea according to the invention results from the fact that by a suitable choice of the displacement surfaces, practically any multiplication ratio can be formed. Due to this fact, it rapidly becomes clear that a door closer has been created that can be adapted to local conditions and hence to the desired or special applications without any problems. The geometric dimensions of the pistons can be designed in many ways, so that the L-shaped pistons do not have to have a rectangular cross section at the displacement surfaces as in the embodiment. These surfaces 11, 12, and 13 can also have any other shape that can be made economically by manufacturing. In the subject of the invention, it becomes apparent that as a result of different piston areas and different channels but with the same housing, different moment curves can be achieved.

The foregoing disclosure has been set forthe merely to illustrate the invention and is not intended to be limiting. Since modifications of the disclosed embodiments incorporating the spirit and substance of the invention may occur to persons skilled in the art, the invention should be construed to include everything eithin the scope of the appended claims and equivalents thereor.

Reference Numbers

1 spring
2 spring piston
3 door piston
4 teeth
5 housing
6 side plate
7 side plate
10 internal piston
11 area

12 area
13 area
21 spring chamber
22 piston chamber
23 piston chamber
24 door piston chamber
25 chamber
26 internal piston chamber
27 internal piston chamber
41 channel
42 channel
43 channel
44 channel
45 channel
46 channel
47 channel
48 channel
53 channel
61 pocket
62 pocket
63 pocket
64 pocket
65 throttle
66 throttle
71 check valve
101 surface
117 sidewall

What is claimed is:

1. Door closer with a door piston guided in a housing and operable to control movement of a rod connected to a door assembly, and a force-storage device in the form of a spring which, during an opening process of the door, supplies the necessary energy for the subsequent automatic closing process, characterized in that the door closer, depending on the travel and the direction, has at least two different multiplication ratios and hence different moment curves, with coupling between the opening force and the closing force being thereby selectively eliminated.

2. Door closer according to claim 1, wherein at least one hydraulic transmission is connected between the spring and the door piston for transmitting hydraulic fluid.

3. Door closer according to claim 2, wherein the hydraulic transmission comprises at least one spring piston, the door piston, and varying space delimited by these pistons and a housing surrounding them.

4. Door closer according to claim 3, wherein the spring piston and the door piston have an L-shaped form and are slidable into one another.

5. Door closer according to claim 4, wherein the spring piston and the door piston each have two displacement surfaces of different sizes for the damping medium.

6. Door closer according to claim 5, wherein a door piston chamber and a spring piston chamber are provided, connected by a channel.

7. Door closer according to claim 5, wherein a housing interior chamber that surrounds the spring piston and the door piston is designed offset in such fashion that the piston chambers can be alternately activated by hydraulic damping and switching means, with damping being performed by means of at least one throttle.

8. Door closer according to claim 5, wherein, with retention of the housing but with piston surfaces shaped differently and with modified channels, different multiplication ratios can be achieved.

9. Door closer according to claim 4, wherein a door piston chamber and a spring piston chamber are provided, connected by a channel.

10. Door closer according to claim 4, wherein a housing interior chamber that surrounds the spring piston and the door piston is designed offset in such fashion that the piston chambers can be alternately activated by hydraulic damping and switching means, with damping being performed by means of at least one throttle.

11. Door closer according to claim 3, wherein a housing interior chamber that surrounds the spring piston and the door piston is designed offset in such fashion that the piston chambers can be alternately activated by hydraulic damping and switching means, with damping being performed by means of at least one throttle.

12. Door closer according to claim 3, comprising hydraulic damping and switching means for controlling hydraulic fluid to control the hydraulic coupling and damped movement of the door piston and the spring piston by said hydraulic damping and switching means in the housing, the spring piston, and the door piston in such fashion that when the door is opened and during its subsequent closing process up to a selectable door opening angle, the spring piston and the door piston move at the same speed as a result of a pressure equalization among all of the piston chambers filled with hydraulic fluid;

the door piston is separated from the spring piston in the subsequent second part of the closing process; and in the third part of the closing process, in which the door is supposed to slam shut, the spring piston and the door piston approach one another again.

13. Door closer according claim 12, wherein, with retention of the housing but with piston surfaces shaped differently and with modified channels, different multiplication ratios can be achieved.

14. Door closer according to claim 3, wherein a door piston chamber and a spring piston chamber are provided, connected by a channel.

15. Door closer according to claim 1, wherein a door, piston chamber and a spring piston chamber are provided, connected by a channel.

16. A door closer assembly comprising:

a housing, a door piston guided in the housing and operable to move a door, a spring piston guided in the housing and operable to assist movement of the door piston toward a door closing position, said spring piston being acted on by a spring, and a hydraulic control circuit containing hydraulic fluid and operable to selectively eliminate a coupling of the door piston and the spring piston from one another during a portion of a travel path of the door piston in the housing.

17. A door closer assembly according to claim 16, wherein said door piston and spring piston include mutually engaging sliding surfaces.

18. A door closer assembly according to claim 17, wherein said door piston and spring piston are L-shaped.

19. A door closer assembly according to claim 18, wherein said hydraulic control circuit includes hydraulic passages in said door piston and spring piston which are selectively communicated with one another at the sliding surfaces in dependence on the relative position of the door piston and spring piston.

20. A door closer assembly according to claim 17, wherein said hydraulic control circuit includes hydraulic passages in said door piston and spring piston which are selectively communicated with one another at the sliding surfaces in dependence on the relative position of the door piston and spring piston.

21. A door closer assembly according to claim 20 wherein said hydraulic control circuit includes hydraulic passages in said housing which are selectively communicated with hydraulic passages in respective ones of the door piston and spring piston in dependence on the relative position of the housing and the respective door piston and spring piston.

22. A door closer assembly according to claim 16, wherein said housing, said door piston, said spring piston, and said hydraulic control circuit are configured to automatically control forces exerted by the door piston on a door such that:

when the door is opened and during its subsequent closing process up to a selectable door opening angle, the spring piston and the door piston move at the same speed as a result of a pressure equalization among all of the piston chambers filled with hydraulic fluid;

the door piston is separated from the spring piston in a subsequent second part of the closing process; and in a third part of the closing process, in which the door is supposed to slam shut, the spring piston and the door piston approach one another again.

23. A door closer assembly according to claim 16, wherein said housing, said door piston, said spring piston, and said hydraulic control circuit are configured to automatically control forces exerted by the door piston on a door such that:

a plurality of different door closing movement ratios are applied by the door piston and spring piston during different ranges of door closing movements of the door piston.

24. A door closer assembly according to claim 23, wherein at least two different door closing movement ratios are provided.

25. A door closer assembly according to claim 23, wherein at least three different door closing movement ratios are provided.

26. A method of operating a door closer assembly having a housing, a door piston movably guided in the housing and operable to move a door, a spring piston movably guided in the housing and operable to assist the movement of the door piston at least in a door closing direction, and a hydraulic circuit containing hydraulic fluid in said housing, said method comprising eliminating a coupling between the spring piston and the door piston with said hydraulic fluid for portions of a door opening and a door closing movement.

27. A method according to claim 26, comprising controlling forces exerted on the door piston such that:

when the door is opened and during its subsequent closing process up to a selectable door opening angle, the spring piston and the door piston move at the same speed as a result of a pressure equalization among all of the piston chambers filled with hydraulic fluid;

the door piston is separated from the spring piston in a subsequent second part of the closing process; and in a third part of the closing process, in which the door is supposed to slam shut, the spring piston and the door piston approach one another again.

28. A method according to claim 26, comprising controlling forces exerted on the door closing piston such that:

a plurality of different door closing movement ratios are applied by the door piston and spring piston during different ranges of door closing movements of the door piston.

29. A door closer assembly comprising:

a housing, a door piston guided in the housing and operable to move a door, a spring piston guided in the housing and operable to assist movement of the door piston toward a door closing position, said spring piston being acted on by a spring, and at least one hydraulic transmission means connected between the spring piston and the door piston for transmitting hydraulic fluid and operable to selectively eliminate a coupling between the door piston and the spring piston during a portion of a travel path of the door piston in the housing, thereby providing the door closer with at least two different multiplication ratios and hence different moment curves.

30. A door closer assembly according to claim 29, wherein the at least one hydraulic transmission means includes at least one spring piston, at least one door piston, and varying space delimited by these pistons and the housing surrounding them.

31. A door closer assembly according to claim 29, wherein said door piston and spring piston include mutually engaging sliding surfaces.

32. A door closer assembly according to claim 31, wherein said door piston and spring piston are L-shaped.

33. A door closer assembly according to claim 31, wherein said at least one hydraulic transmission means includes a hydraulic control circuit having hydraulic passages in said door piston and spring piston which are selectively communicated with one another at the sliding surfaces in dependence on a relative position of the door piston and spring piston.

34. A door closer assembly according to claim 33, wherein said hydraulic control circuit includes hydraulic passages in said housing which are selectively communicated with hydraulic passages in respective ones of the door piston and spring piston in dependence on a relative position of the housing and the respective door piston and spring piston.

* * * * *